United States Patent [19]

Murphy et al.

[11] 3,956,907

[45] May 18, 1976

[54] TAKE UP

[75] Inventors: Lonnie A. Murphy, Chattanooga, Tenn.; Larry E. Rankin, Rossville, Ga.

[73] Assignee: Wadsworth-Greenwood Corporation, Dalton, Ga.

[22] Filed: Mar. 4, 1974

[21] Appl. No.: 447,892

[52] U.S. Cl. ..... 66/149 R; 66/153

[51] Int. Cl.[2] ..... D04B 15/88

[58] Field of Search ..... 66/149 R, 150, 152, 66/153

[56] References Cited

UNITED STATES PATENTS

| | | | |
|---|---|---|---|
| 1,065,215 | 6/1913 | Childrey | 66/149 R |
| 2,710,530 | 6/1955 | Burdett | 66/153 |
| 2,789,423 | 4/1957 | Vaclavik et al. | 66/149 R |
| 3,186,443 | 6/1965 | Budzyna | 66/149 R |
| 3,442,100 | 5/1969 | Manger et al. | 66/153 |

*Primary Examiner*—Mervin Stein
*Assistant Examiner*—Andrew M. Falik
*Attorney, Agent, or Firm*—Sherman & Shalloway

[57] ABSTRACT

Apparatus for tensioning textile material as the material is knitted from a strand of yarn into an elongated sock by a circular knitting machine includes a first roller over which the sock is passed and a second roller which urges the sock into engagement with the first roller. The first roller has a left-hand helix on one half of its surface which advances from the center of the roller to the edge of the roller as the roller rotates, and has a right-hand helix on the other half which advances from the center of the roller to the opposite end of the roller as the roller rotates. These helixes hold the sock in alignment between the first and second rollers. The first roller is driven by a belt and pulley arrangement and the second roller is free-wheeling so that it is rotated by tangential force applied thereto through the sock.

2 Claims, 5 Drawing Figures

TAKE UP

BACKGROUND OF THE INVENTION

1. Field of the Invention

This invention relates to apparatus for tensioning and advancing material, such as textile material. More particularly, this invention relates to tensioning and advancing material while dynamically maintaining alignment of the material.

2. Technical Considerations and Prior Art

In the manufacture of textiles, it is a frequent practice to knit strands of yarn into tubular configurations generally referred to as yarn socks so that the strands of yarn may be conveniently processed while in a readily deknitted, bulk form.

In processing yarn which will eventually be woven into carpets, knitting yarn into yarn socks is generally a standard practice prior to dyeing the yarn.

In the past, numerous difficulties have been encountered in knitting strands of yarn into these socks. Generally, these difficulties involve numerous broken needles in the knitting machines and lack of uniformity in the coarse of the knit produced by different knitting machines.

It has been found by the inventors of the present invention that these problems are, by and large, created downstream of the knitting machine by the apparatus which tensions and advances the socks as they emerge from the knitting machine. The prior art tensioning apparatus generally utilizes a pair of rollers between which the socks are passed. The rollers are both positively driven and are biased together by a pair of springs acting on opposite ends of one of the rollers. A major problem with this type of roller is that it is difficult to distribute the force from which the rollers engage the socks equally over the surfaces of the socks. This is because it is necessary to coordinate the tension on the two springs by advancing and retracting adjustment screws which compress the springs. The adjustment to the springs also effects the stitch density of the socks knitted by the heads. Due to the fact that there are two springs with each set of rollers, this becomes a tedious and difficult task, often resulting in knitting heads which produce non-uniform socks that, when later woven into textile products such as carpets, produce products of inferior quality.

It has been found that the positive drive utilized with this prior art system causes needles in the knitting heads to frequently break because the positive drives apply tension to the socks, which increases dramatically when the yarn for some reason becomes hung up on one or more needles. This tension can then, of course, be transferred to other needles, resulting in additional needle breakage. When the needles in the knitting machines break, the knitting machines must be stopped and the needles replaced so that the stitch of the socks will be uniform and will not be afflicted with runs or other anomalies. Furthermore, the machines must be stopped to remove the broken needles so that the needles do not become entangled in the various mechanisms associated with the knitting machines.

SUMMARY OF THE INVENTION

In view of the afore-mentioned difficulties and other difficulties, it is an object of the instant invention to provide a tensioning and advancing apparatus for materials, such as textile materials, wherein the materials are maintained in alignment within the tensioning and advancing apparatus.

Another object of the instant invention is to provide new and improved apparatus for tensioning and advancing material, such as textile material, so that the material will not apply undue force or tension on mechanisms associated with work stations, such as knitting machines, disposed upstream from the apparatus.

It is a further object of the instant invention to provide tensioning and advancing apparatus wherein the apparatus includes a pair of rollers through which material, such as textile material, is passed and wherein the force with which the rollers are urged into engagement with the material is easily and readily adjustable.

It is still another object of the instant invention to provide new and improved apparatus for tensioning and advancing material, such as textile material, wherein the material has randomly occurring thickened portions, such as knots, globs of glue or the like, and wherein the apparatus has structures associated therewith to accommodate these thickened portions without substantially affecting the advancement of the material therethrough.

In view of these and other objects, the present invention contemplates an apparatus for applying tension to fabric, such as textile material, to pull the fabric through a work station, such as a circular knitting machine. The apparatus includes a first roller means and a second roller means which is urged into engagement with the first roller means to hold the fabric therebetween. The first roller means has a working surface thereon which maintains alignment of the fabric between the first and second roller means by spreading the fabric in opposite directions parallel to the axes of the rollers. In order to tension the fabric and pull the fabric through the work station, means are included for transmitting rotary motion to the first roller to rotate the roller and thereby advance the fabric which is urged into engagement with the first roller by the second roller.

In addition, the present invention contemplates providing the afore-described working surface with a pair of helixes having opposite hands so that as the roller rotates, the helixes advance from the center of the roller to opposite ends of the roller. In addition to the pair of helixes, each working surface has longitudinally disposed grooves therein which will accommodate any thickened portions in the fabric such as globs of glue or knots that randomly and frequently occur in textile yarn.

BRIEF DESCRIPTION OF THE DRAWINGS

The present invention will become more fully understood from the following detailed description and the accompanying drawings, in which.

DETAILED DESCRIPTION

Figure 1:
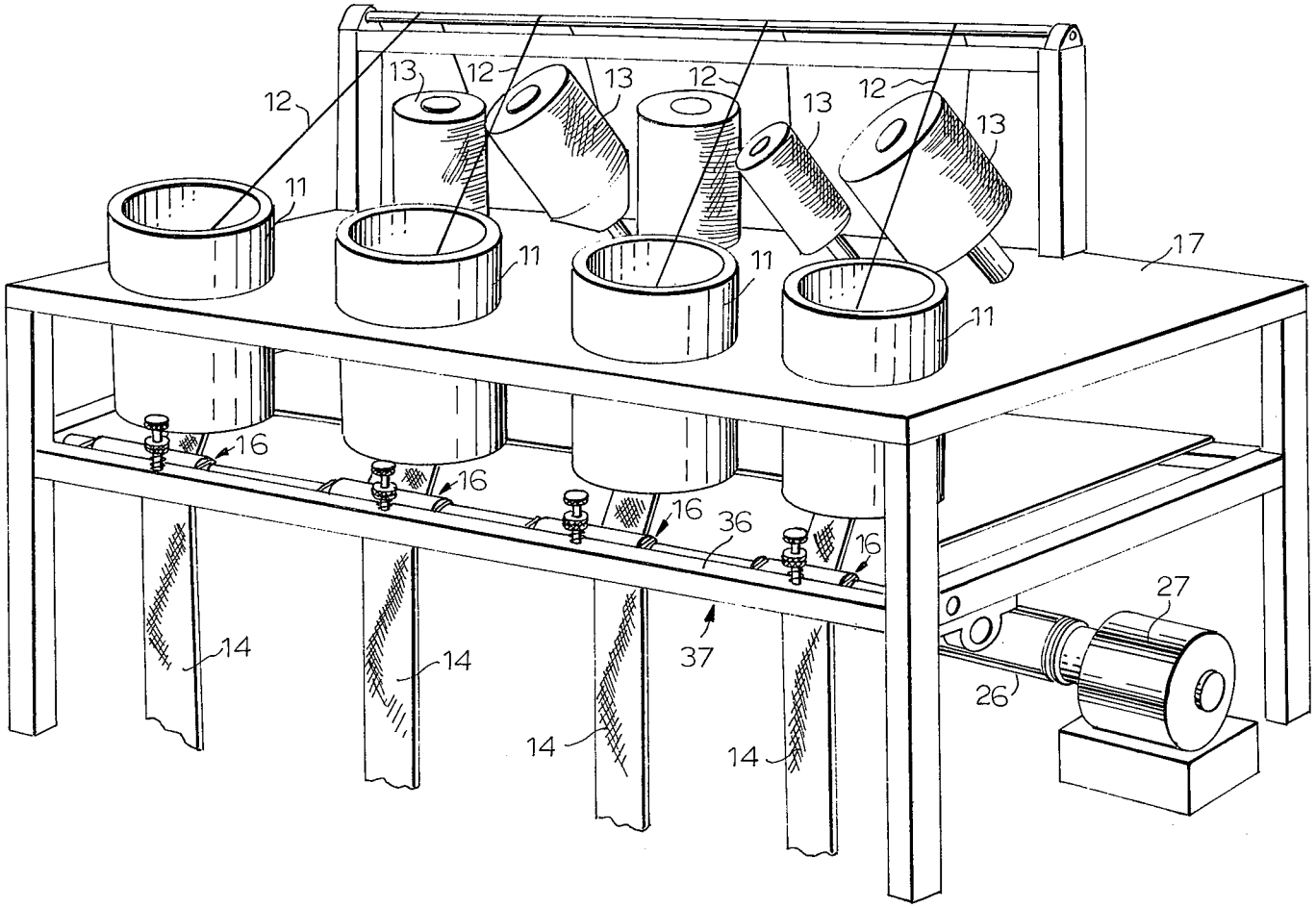
FIG. 1 is a perspective view of a plurality of schematically shown knitting machines which are knitting strands of yarn into tubular socks and are using a tensioning and advancing apparatus according to the present invention.

Referring now to FIG. 1, there is shown schematically a plurality of circular knitting machines 11-11 which receive individual strands of yarn 12-12 from wound yarn packages 13-13 and knit the strands of yarn into tubular socks 14-14. After the strands of yarn 12 are knitted into the tubular socks 14, the socks are processed through a dyeing apparatus or other treating apparatus (not shown). The strands of yarn 12 are then deknitted for subsequent weaving into textile products, such as carpets. In order to manufacture high quality textile products, it is necessary that the yarn 12 emerges from the treating apparatus with a high degree of uniformity. If the knitting stitch in socks 14-14 is not uniform, then the yarn will not have a uniform character as it emerges from the treating apparatus.

In order to achieve uniformity in the knit between the various socks 14-14, it is necessary that uniform tension be applied to each sock downstream from the knitting machines 11-11. This is accomplished in the instant invention by the tensioning and advancing apparatus 16-16 which is mounted on the frame 17 which holds the circular knitting machines 11-11.

Figure 2:
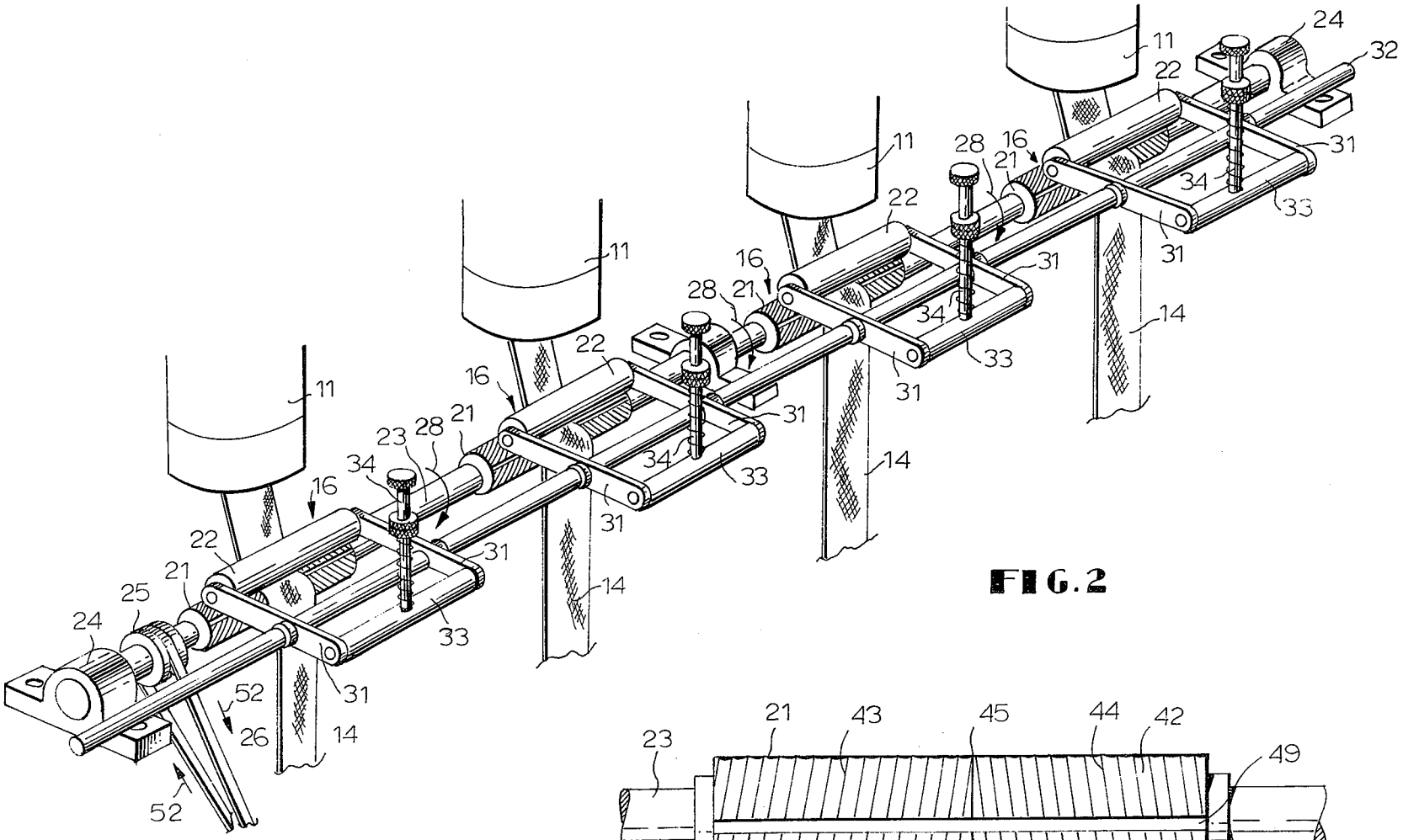
FIG. 2 is a perspective view showing the details of the advancing and tensioning apparatus of FIG. 1.

Referring now to FIG. 2, where the tensioning and advancing apparatus 16-16 is shown with the mounting frame 17 removed, it is seen that each apparatus has a first roller 21 and a second roller 22 between which one of the tubular socks 14 passes. In the illustrated embodiment, tubular sock 14 passes over the roller 21 so as to drape therefrom while the roller 22 sits on top of the sock.

In order for the apparatus 16 to tension and advance the socks 14, the rollers 21, in the illustrated embodiment, are each keyed or otherwise secured to a shaft 23 which is journalled in a pair of bearings 24 that are secured to the frame 17 (see FIG. 1). The shaft 23 has a smooth pulley 25 non-rotatably secured thereto around which an endless drive belt 26 is trained. As the belt 26 is driven by an electric motor 27, the shaft 23 is rotated in a clockwise direction as illustrated by the arrows 28-28. This causes the rollers 21 to apply a tangential force to the socks 14 which are held in engagement with the rollers 21 by the rollers 22.

In the illustrated embodiment, the rollers 22-22 are journalled at each end to pairs of arms 31-31 that are, in turn, rotatably mounted on a stationary shaft 32. Each pair of arms 31-31 has a bar 33 journalled in the ends thereof opposite the rollers 22. Each bar 33 has a shaft 34 rigidly attached thereto and extending upwardly therefrom. The shafts 34-34 pass through a horizontal portion 36 in a strut 37 of the frame 17 and each has a coil spring 38 therearound which is compressed between an adjustment net 39 and the top of the horizontal surface 36. This arrangement is perhaps best seen in the enlarged view of FIG. 4.

As the nut 39 is advanced toward the horizontal flange 36, the spring 38 is compressed and exerts an increasing force on the shaft 34 which is upwardly directed, as shown by the arrow 41. This causes an upward force to be directed against the bottom of the adjustment nut 39 which applies a downward force on the roller 22 so as to urge the roller 22 against the sock 14 to squeeze the sock 14 between the rollers 22 and 21. Therefore, as the roller 21 rotates in the clockwise direction of the arrow 28, it will apply a tangential force to the sock 14 so as to tension and advance the sock 14.

Figure 3:
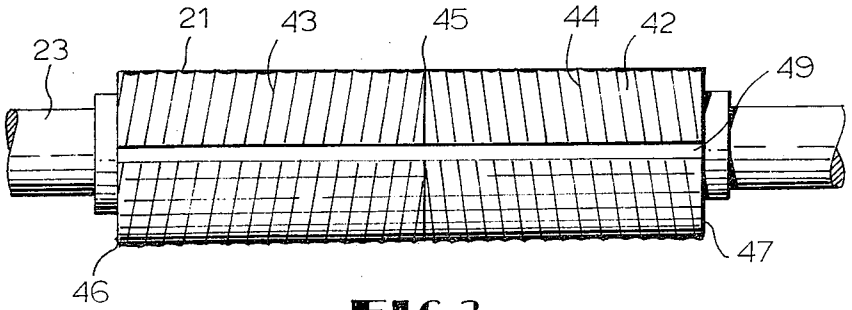
FIG. 3 is a top elevation of a roller which is used with the tensioning and advancing apparatus and showing two helical grooves of opposite hand cut into the roller and one of a plurality of longitudinal grooves cut into the roller.
Figure 4:
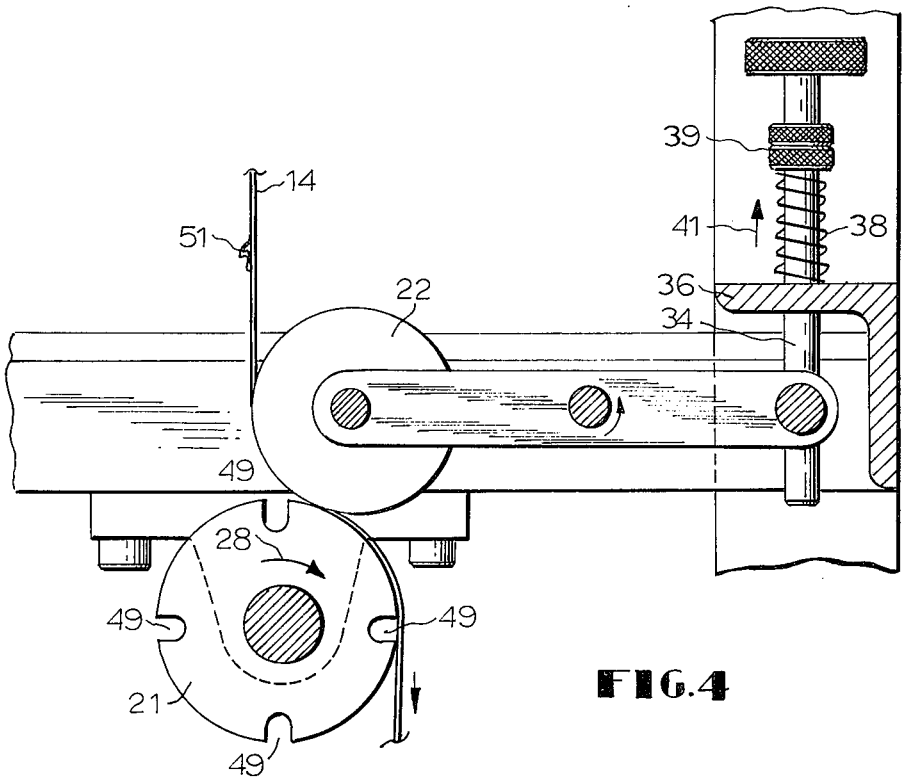
FIG. 4 is a side elevation of one tensioning and advancing apparatus according to the instant invention.
Figure 5:
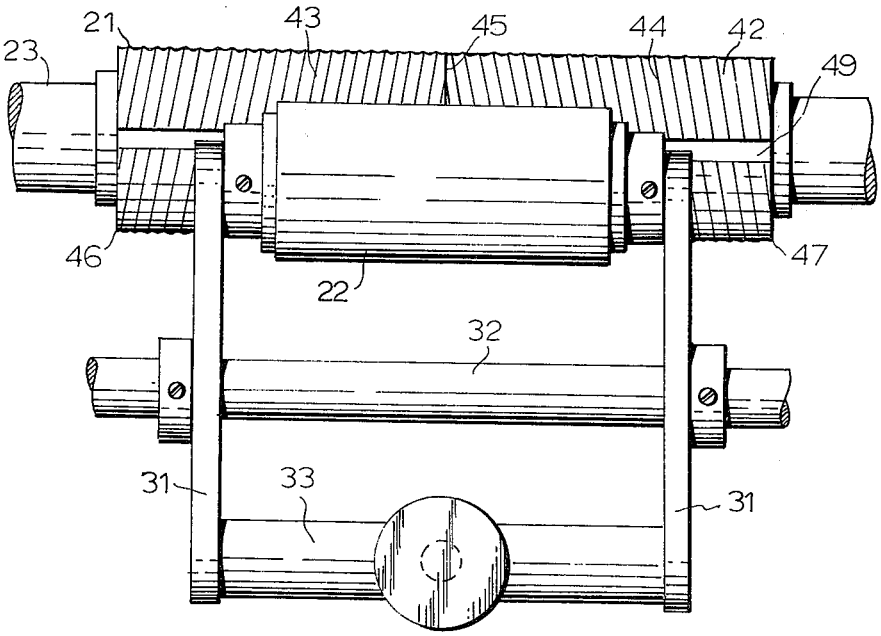
FIG. 5 is a top view of the apparatus of FIG. 4.

In order for the sock 14 to remain in alignment between the rollers 21 and 22, the roller 21 has a working surface 42 that has first and second helical grooves 43 and 44, respectively, cut therein. As seen in FIG. 3, the helical grooves 43 and 44 are of opposite hand, so that as the roller 21 rotates in a clockwise direction (as seen in FIG. 4), the groove 43 will advance from the center 45 of the roller to the left-hand edge 46 of the roller, while the groove 44 will advance from the center of the roller to the right-hand edge 47 on the roller. Since the sock 14 is squeezed between the two rollers, one half of the sock will tend to advance toward the end 46 of the roller, while the other half will tend to advance toward the end 47 of the roller because the sock is held in relatively tight engagement with the grooves 43 and 44 by roller 22. This tendency to spread the sock toward the ends 46 and 47 of the roller causes the sock to generally remain aligned with the center 45 of the roller. Since the roller 21 is grooved, it is able to apply sufficient traction to the sock 14 in order to advance the sock. Accordingly, the roller 22 may have a smooth surface and need not be positively driven, but may simply free-wheel between the ends of the arms 31 as the roller 21 advances the sock 14.

In addition to the helical grooves 43 and 44, the working surface 42 of the roller 21 has longitudinal grooves 49-49 cut therein. As seen in FIG. 4, each roller 21 has four of these longitudinal grooves 49-49. The grooves 49-49 enable the tensioning and advancing apparatus 16 to accommodate randomly occurring thickened portions, such as the thickened portion 51 (see FIG. 4), which occur on the socks 14. These thickened portions 51 may be knots in the yarn strands 12, globs of glue or the like. When the thickened portions arrive at the point where they must pass between the rollers 21 and 22, the roller 21 will slip until the thickened portions can be engaged by one of the slots 49, whereupon the thickened portions will enter the slots 49 and no longer jam between the rollers 21 and 22. As the roller 21 continues to rotate in the direction of the arrow 28, the trailing edge of the slot 49 engaging the thickened portion 51 will engage the thickened portion and tend to push it between the rollers while, at the same time, the roller 22 under the urging of spring 38 will push the thickened portion into the slot 49. The thickened portion 51 will then be carried between the rollers 21 and 22 and the sock 14 will continue to be tensioned and advanced.

Referring now again to FIG. 2, it is seen that the shaft 23 is driven by the pulley 25 as the belt 26 moves in the direction of arrows 52-52. The pulley 25 is frictionally driven by the belt 26; that is to say, there is no positive connection between the pulley and the belt. Accordingly, if motion of one of the socks 14 is restrained by one of the needles (not shown), becoming temporarily entangled by the yarn 12 (see FIG. 1), tension in the sock 14 will build up due to traction force between the roller 21 and the sock 14. When this tension reaches too high a level, the belt 36 will slip relative to the pulley 25 which, in many cases, prevents needles (not shown) in the knitting machines 11 from breaking. During the instant, or rather short, period of time that the yarn 12 is entangled with one, or perhaps more, of the needles in the knitting machines 11, tension is continually applied to the socks 14. However, this tension is limited due to the fact that there is slippage between the belt 26 and the pulley 25. Usually, the yarn 12 will become disentangled from around the needle during this period of time and the sock 14 will continue to advance between the rollers 21 and 22.

As previously mentioned, it is necessary that each sock 14 have a uniform knit in order to subsequently process the yarn 12 with uniform results. Since the closeness of the knit is effected by the tension between the tensioning and advancing apparatus 16-16 and the circular knitting machines 11, it is necessary that each apparatus 16 has the same tension. This is accomplished by adjusting the nuts 39 so that each spring 38 exerts the same force. By adjusting one of the nuts 39 to achieve a desired stitch density and then adjusting each of the other nuts 39 until the stitch density of each sock 14 affected thereby is identical to that of the first sock, uniformity is easily obtained. Since the shaft 23 carries all of the rollers 21, the same rotational force will be exerted by each roller 21 if the same compression force is exerted by each of the rollers 22.

Referring now to FIG. 1 where a plurality of the circular knitting machines 11 is shown, it is readily seen that the tensioning apparatus 16 may replace any existing tensioning apparatus. Accordingly, a processor of textile yarn may improve his line by simply removing his old tensioning and advancing apparatus and replacing his old apparatus with an apparatus embodying the principles of the present invention.

While the apparatus of the instant invention has been illustrated by way of the foregoing drawings and embodiment, which are for the purpose of illustration only, the apparatus for practicing the instant invention is limited only by the following appended claims.

What is claimed is:

1. An apparatus for applying tension to and advancing a knitted sock as the sock is knitted from yarn by a circular knitting machine, comprising:

a rotatable first roller over which the sock passes;

a freely rotatable second roller having a substantially smooth working surface and urging the sock into engagement with the first roller;

arm means having first and second ends, and rotatably mounting said second roller adjacent to said first end;

stationary shaft means displaced from said second roller and disposed intermediate the ends of said arm means;

spring means operatively engaging the second end of said arm means to bias said arm means rotationally about said shaft means and to, therefore, resiliently urge said second roller to press the sock into engagement with said first roller;

means for adjusting the force of said spring means to adjust the pressure with which the second roller presses the sock into engagement with the first roller;

a working surface on the first roller for aligning the sock to advance in a substantially normal direction relative to the rotational axes of the rollers, said working surface including a pair of adjoining helical grooves of opposite hand, which start in the center of the first roller and which advance toward opposite ends of the roller as the roller rotates;

longitudinally extending surface grooves disposed in said first roller to accommodate randomly occurring thickened portions of the sock, said grooves being spaced from one another over a substantial portion of the surface of the first roller; and means for transmitting rotary motion to said first roller to both tension and advance the sock, wherein said transmitting means includes a driven belt trained around a smooth pulley connected to said first roller to form a slidable friction drive for allowing said first roller to cease rotation relative to the sock while still applying tension to the sock to thereby accommodate situations where the sock is momentarily restrained from advancement by the knitting machine.

2. The apparatus of claim 1, wherein there are four grooves located in the first roller and wherein the grooves are spaced 90° from one another.

* * * * *